US005287933A

United States Patent [19]

Lindblom

[11] Patent Number: 5,287,933

[45] Date of Patent: Feb. 22, 1994

[54] HOOD SUPPORT ASSEMBLY FOR AN EARTH WORKING MACHINE

[75] Inventor: Victor E. Lindblom, Brooklyn Center, Minn.

[73] Assignee: Caterpillar Pavin, Products Inc., Minneapolis, Minn.

[21] Appl. No.: 829,013

[22] PCT Filed: Oct. 22, 1991

[86] PCT No.: PCT/US91/07757

§ 371 Date: Oct. 22, 1991

§ 102(e) Date: Oct. 22, 1991

[51] Int. Cl.[5] ..... A01B 17/00; A01B 33/16

[52] U.S. Cl. ..... 172/112; 172/508; 172/72; 404/90

[58] Field of Search ..... 172/508, 512, 112, 123, 172/497, 515, 572, 72; 37/223; 15/83, 340.3, 340.4, 346; 404/90

[56] References Cited

U.S. PATENT DOCUMENTS

| | | | |
|---|---|---|---|
| 3,147,577 | 9/1964 | McClellan et al. | 172/112 |
| 3,661,213 | 5/1972 | Taylor | 172/112 |
| 3,746,101 | 7/1973 | Takata | 172/112 |
| 3,995,570 | 12/1976 | van der Lely | 172/112 |
| 4,458,763 | 7/1984 | Rao et al. | 172/112 |
| 4,664,201 | 5/1987 | Pegovaro | 172/112 |
| 4,669,549 | 6/1987 | Sanpei et al. | 172/112 |
| 4,786,111 | 11/1988 | Yargici | 404/90 |

FOREIGN PATENT DOCUMENTS

| | | | |
|---|---|---|---|
| 2803893 | 8/1978 | Fed. Rep. of Germany | 172/112 |
| 240358 | 3/1989 | U.S.S.R. | 172/112 |

*Primary Examiner*—Randolph A. Reese
*Assistant Examiner*—Spencer Warnick
*Attorney, Agent, or Firm*—Robert A. McFall

[57] ABSTRACT

A hood support assembly (18) for controllably supporting a hood member (16) on an earth working machine (10) includes a support member (20) that is pivotally mounted, at each of two end portions (22,24) to the frame (12) of the machine. Arm members (26,28) and stop members (42,44) are attached to each of the end portions (22,24) of the support member (20). A pair of adjustable links (34,36) respectively pivotally connect the hood member (16) to each of the arm members (26,28). A pair of springs (52,54) attached to the frame (12) cooperate with the stop members (42,44) to maintain the lateral orientation of the hood member (16) with respect to the frame (12) and support a portion of the weight of the hood member during ground engaging operation of the machine (10).

3 Claims, 4 Drawing Sheets 12
26
18
34
42
52
66(66')
70
14
70(70')
72(72')
16
64
68

HOOD SUPPORT ASSEMBLY FOR AN EARTH WORKING MACHINE

DESCRIPTION

1. Technical Field

This invention relates generally to a machine for surface stabilization, repairing, reconditioning, or taking-up of road or like surfaces, and more particularly to an assembly for supporting a protective hood on such machines.

2. Background Art

Soil stabilizing and conditioning, and road reclaiming, machines having a horizontally disposed rotary cutter for working the soil or roadway material are well known in the art. A machine of this type is described in U.S. Pat. No. 3,746,101, issued Jul. 17, 1973 to Harry H. Takata, and later assigned to the assignee of the present invention. Such machines typically have a protective hood over the rotary cutter that forms an open bottom mixing chamber for pulverizing materials excavated by the cutter. The hood may further provide a support for nozzles or other fixtures by which additives are delivered to the mixing chamber and blended with the excavated material.

To best serve these functions, it is important that the bottom surface of the hood be in operative contact with the ground during operation of the machine. However, to prevent excessive wear on the bottom surface of the hood and lessen power consuming drag forces, it is also important that the full weight of the hood not be supported entirely by ground contact. In an effort to overcome this problem, Takata, in addition to the use of an adjustable gate in front of the cutter, levitates a substantial portion of the weight of the hood with a pair of elastomeric tension members disposed between the hood and the frame of the machine. It has been found that the elastomeric tension members have a limited service life and require periodic inspection and replacement.

More recently, the hood has been supported by a hydraulic cylinder positioned between the hood and the frame. To assure coordinated movement of the hood and the rotary cutter, the hood support cylinder is hydraulically connected, i.e., included in the same pressure controlled hydraulic circuit, as the rotary cutter lift cylinders. This arrangement, which has a much improved service life over the elastomeric tension members, is more costly and is only partially effective in providing consistent counterbalancing support for the weight of the hood during cutting operations.

The present invention is directed to overcoming the problems set forth above. It is desirable to have a hood support arrangement for a soil stabilizing or road reclaiming machine that consistently provides controlled support for a substantial portion of the weight of the hood during earth working operations. Furthermore, it is desirable to have such a hood support arrangement that is economical to build and maintain and which also has a long service life.

DISCLOSURE OF THE INVENTION

In accordance with one aspect of the present invention, a hood support assembly for a hood on an earth working machine includes a support member that has two end portions and is pivotally connected to the frame of the machine at each of the end portions. An arm member and a stop member are also attached to the support member at each of the end portions. An adjustable link is connected between each of the arm members and the hood, and a contact surface is provided on each of the stop members. A pair of springs are attached to the frame of the machine and are positioned so that an end portion of each spring is abuttable with the contact surface of a respective stop member.

Other features of the hood support assembly include an end of each spring being in forcedly abutting contact with a respective contact surface when the hood is in contact with the ground, and spaced from the respective contact surface when the hood is in a raised position.

BEST MODE FOR CARRYING OUT THE INVENTION

Figure 1:
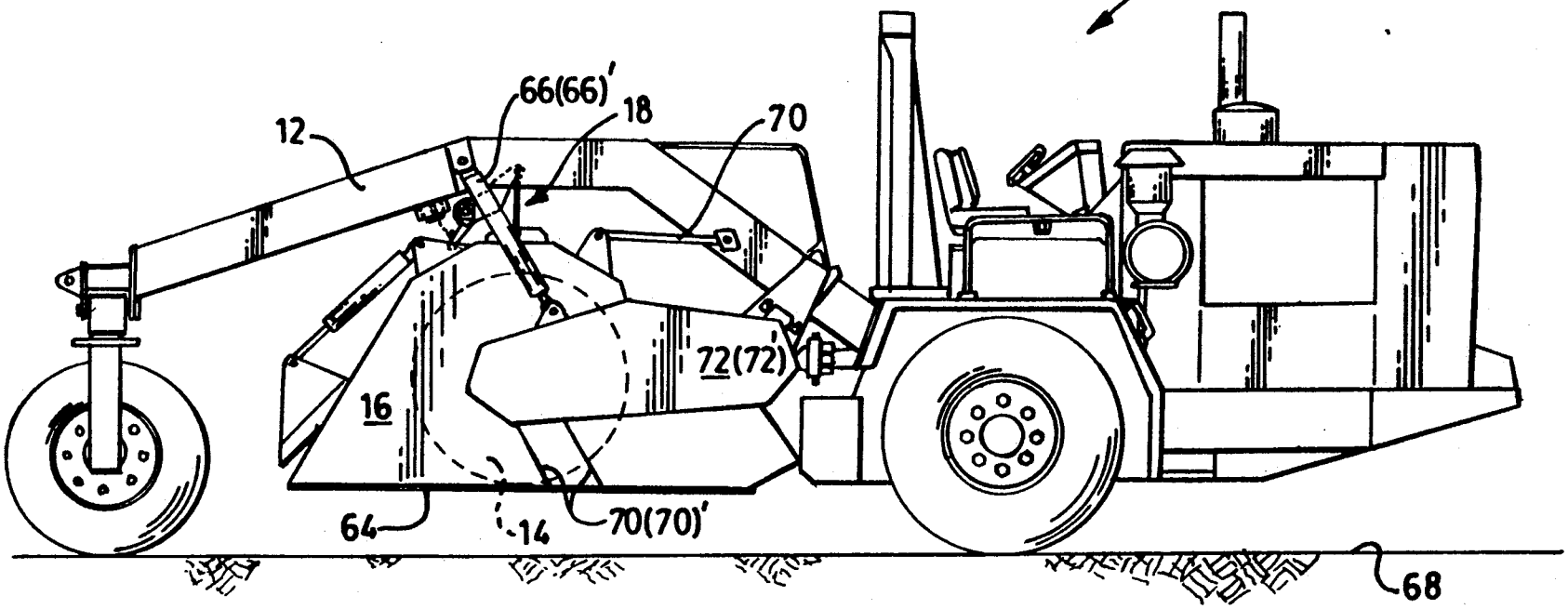
FIG. 1 is a side view of an earth working machine embodying the present invention.
Figure 2:
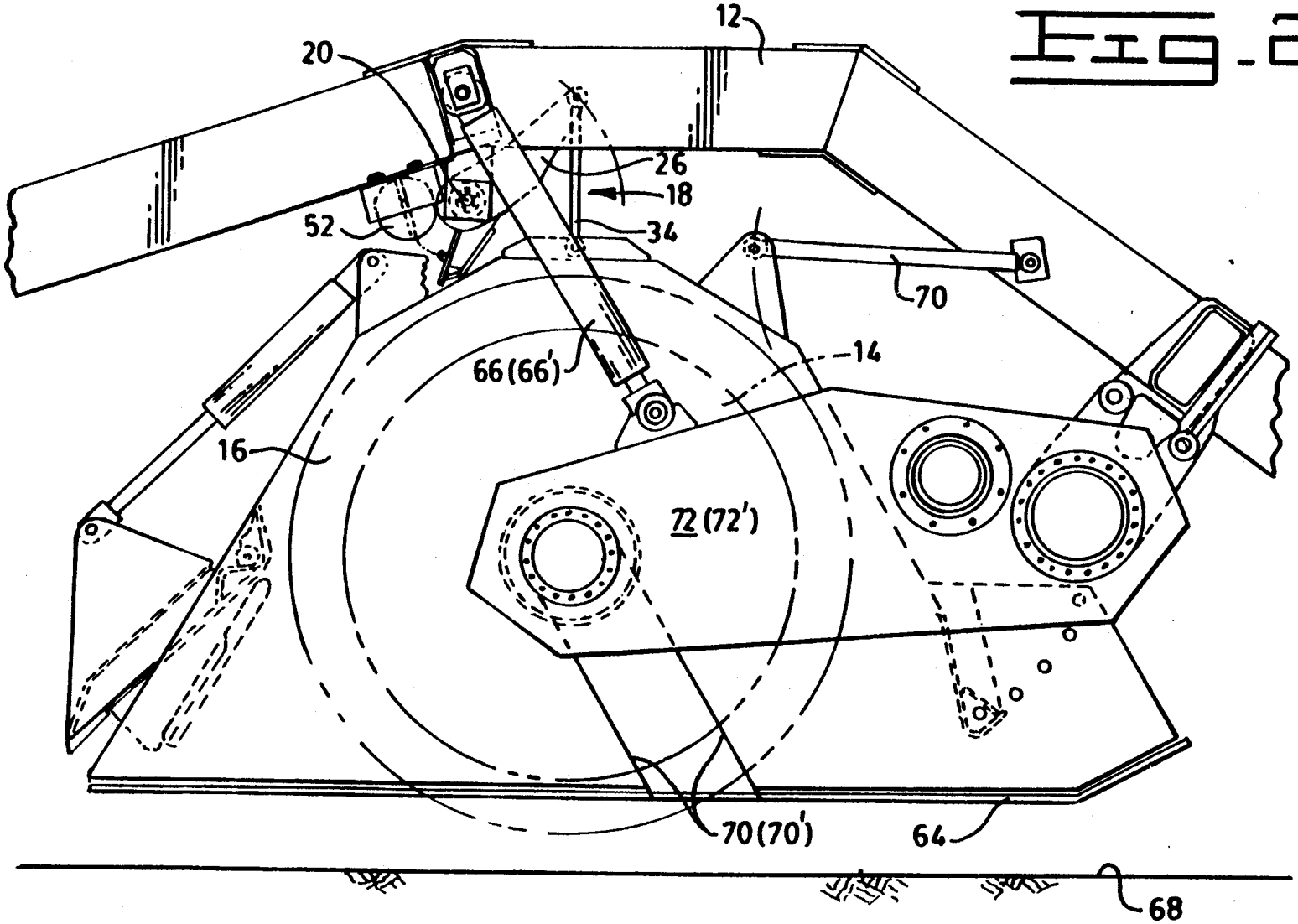
FIG. 2 is a side view of the hood and hood support assembly embodying the present invention, with the hood in a raised, or transport, position.

An earth working machine 10, such as a soil stabilizer or a road reclaimer as shown in FIG. 1, typically has a frame 12, a horizontally disposed and vertically movable rotor 14 having ground engaging tools mounted thereon, and a hood member 16 that forms an open bottom mixing chamber about the rotor 14.

Figure 5:
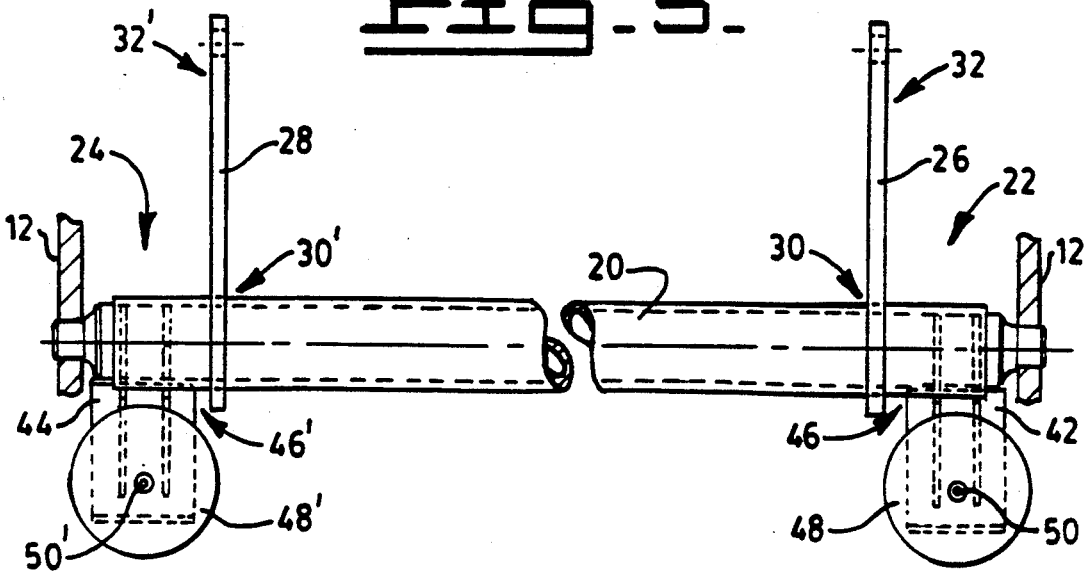
FIG. 5 is a sectional view taken along the line 5—5 of FIG. 4 showing, in plan view, a portion of the of the hood support assembly embodying the present invention.

In the preferred embodiment of the present invention, the earth working machine 10 has a hood support assembly 18 that is carried on the frame 12 and is adjustably connected, as described below, to the hood member. As best shown in FIG. 5, the hood support assembly 18 has a support member 20, preferably a metal tube or bar, having a length somewhat greater than the width of the frame 12. The support member 20 has first and second end portions 22,24 respectively disposed at oppositely spaced ends of the support member 20, and is pivotally connected to the frame 12 at each of the end portions 22,24.

The hood support assembly 18 also has a first arm member 26 and a similar second arm member 28. Each of the arm members 26,28 have a first portion 30,30' and a second end portion 32,32' spaced from the respective first end portion. The first end portions 30,30' of the arm members 26,28 are rigidly attached to the support member 20 at a respective end portion 22,24 of the support member, i.e., the first end portion 30 of the first arm member 26 is attached at the first end portion 22 of the support member 20, and the first end portion 30' of the second arm member 28 is attached at the second end portion 24 of the support member 20.

Figure 4:
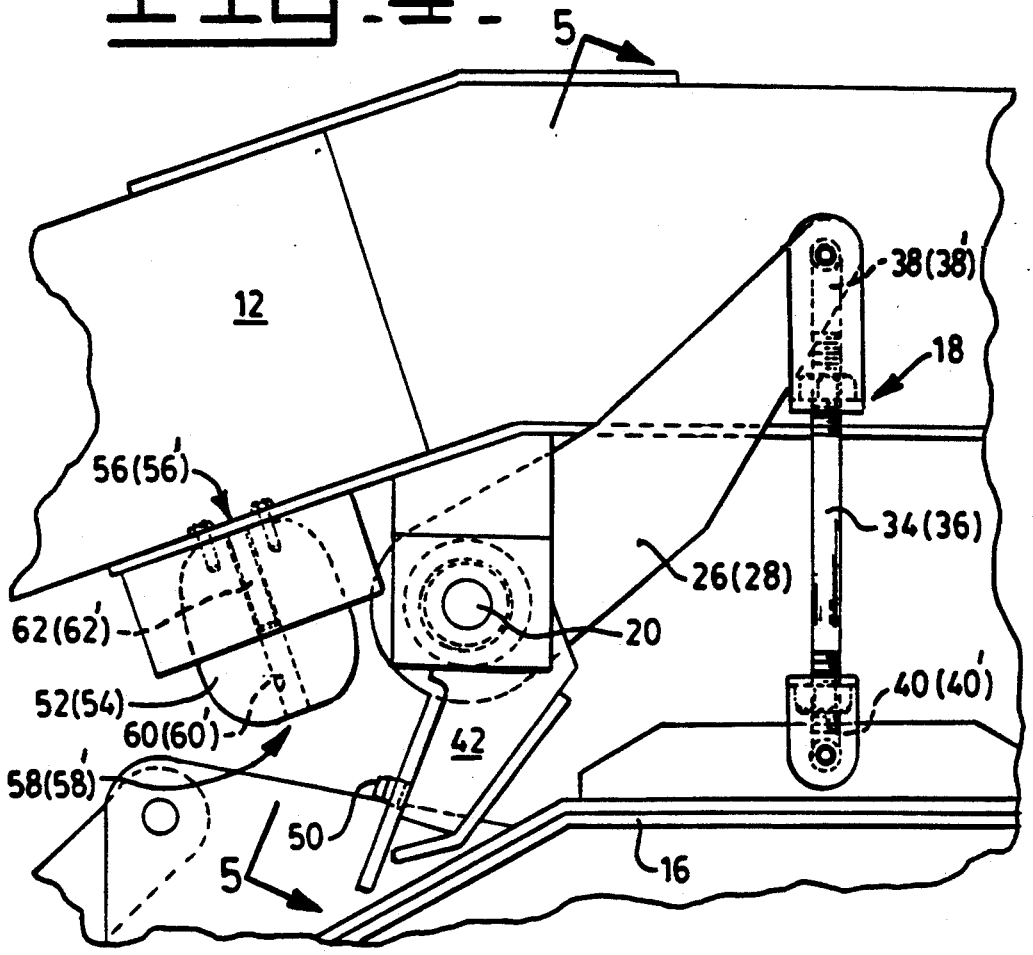
FIG. 4 is a side view of the hood support assembly embodying the present invention.

The hood support assembly 18 also includes a first adjustable link 34 and a similar second adjustable link 36. Each of the adjustable links 34,36 have a first end portion 38,38' and a second end portion 40,40' spaced from the respective first end portion. As best shown in FIG. 4, the first end portions 38,38' of the adjustable links 34,36 are pivotally connected to the second end portion 32,32' of a respective one of the arm members 26,28, and the second end portions 40,40' of the adjustable links 34,36 are pivotally connected to the hood member 16. Preferably, the adjustable links 34,36 are metal rods having threaded ends. Clevis connectors at each end of the rod are adjustably positioned on the link by threaded nuts. The links 34,36 are pivotally secured to the respective arm member and to the hood by a pin extending through the clevis connector and the associated arm member 26,28 or a flange provided on the hood member 16. Alternatively, the adjustable links 34,36 may have a turnbuckle, hook bolt, eye bolt, or similar length-adjustable construction.

In the preferred embodiment of the present invention, the hood support assembly 18 further includes a first stop member 42 and a similar second stop member 44. Each of the stop members 42,44 have an end portion 46,46' and a contact surface portion 48,48' spaced from the respective end portion. The end portions 46,46' of the stop members 42,44 are rigidly attached to the support member 20 at a respective end portion 22,24 of the support member. The contact surface portions 48,48' of the stop members 42,44 are essentially circular metal disks having a centrally disposed pin 50,50' extending outwardly from the face surface of each disk. The stop members 42,44 are mounted on the support member 20 at a position that is in vertical alignment with a portion of the frame 12 extending above the support member.

Importantly, the hood support assembly 18 embodying the present invention includes a first spring 52 and a second spring 54. Each of the springs 52,54 have a first end portion 56,56' and a second end portion 58,58'. The first end portions 56,56' of the springs 52,54 are attached to the frame at a position at which the respective second end portions 58,58' are in an aligned and abutting relationship with respective ones of the contact surface portions 48,48' when the hood member 16 is in a lowered, ground contacting position.

Preferably, the springs 52,54 are spherical elastomeric springs having a threaded mounting plate at the first end portions 56,56' for securing the springs to the frame 12, and a centrally disposed opening 60,60' extending through each of the elastomeric springs between their respective first and second end portions. Elastomeric springs of this type are typically used as bumpers, snubbers, or suspension elements on vehicles and machines. It is also desirable to have a pair of spring compression limit pins 62,62' disposed respectively in each of the central openings 60,60' and extending outwardly from the frame 12. As explained in more detail below, the compression limit pins 62,62' cooperate with the pins 50,50' on the contact surface portions 48,48' of the stop members 42,44 to prevent excessive compression of the elastomeric springs 52,54.

Typically, the hood member 16 of an earth working machine 10 of the type shown and described herein, is provided with a wear resistant surface or skid 64 on the bottom of the hood member. A pair of hydraulic cylinders 66,66' connect a pair of rotor drive cases 72,72' to the frame 12 and vertically position the rotor 14 with respect to the frame 12. Hence, the depth of ground penetration of the ground engaging tools mounted on the rotor is controlled by retraction or extension of the hydraulic cylinders.

Figure 3:
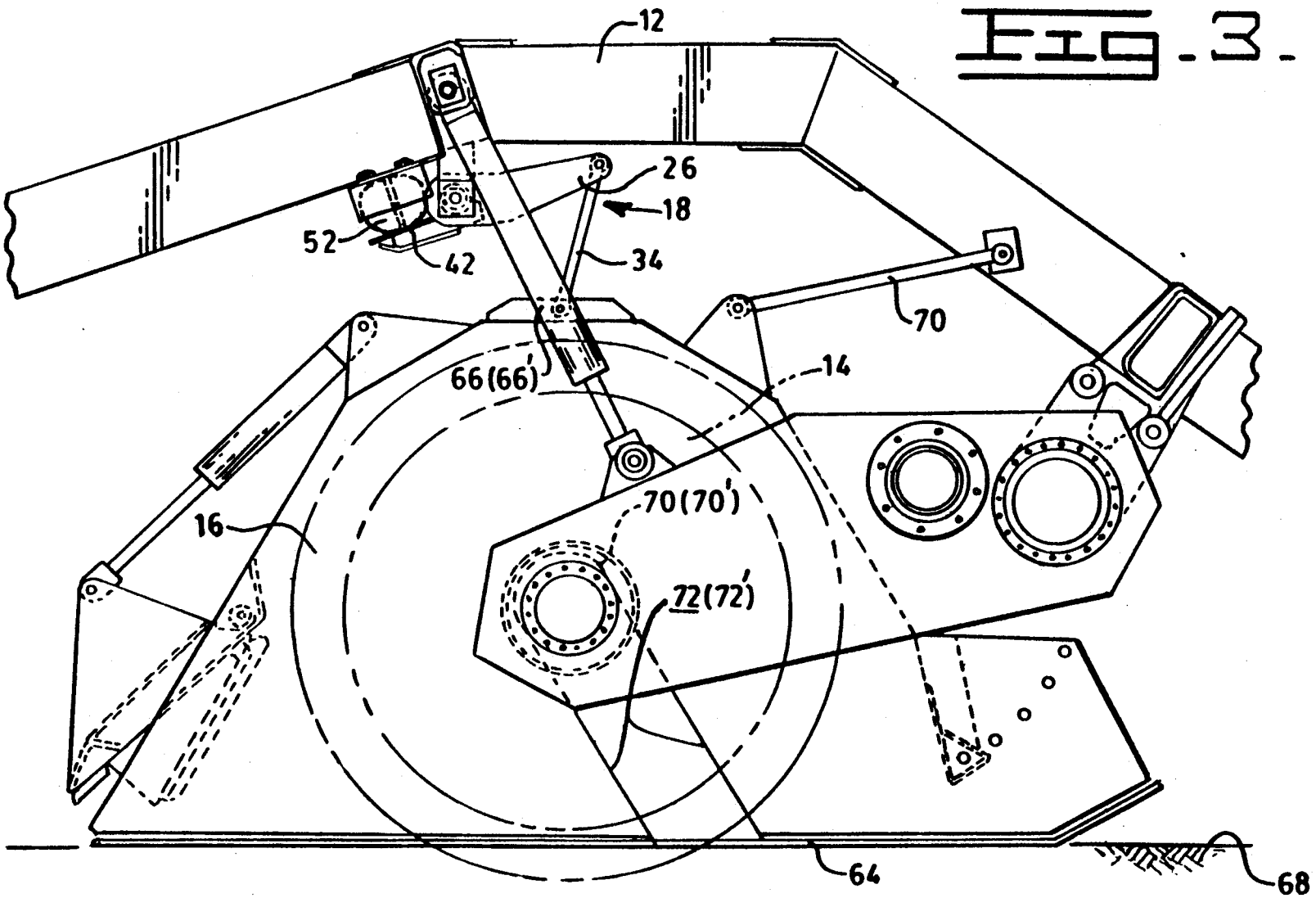
FIG. 3 is a side view of the hood and hood support assembly embodying the present invention, with the hood in a lowered, or operative, position.

During normal operation, the cutting elements of the rotor 14 are in contact with, or are extended a predetermined distance below, a ground surface 68 supporting the machine 10. In order to form an effective enclosure about the rotor 14 when the rotor 14 is excavating or mixing material, it is important that the bottom surface 64 of the hood member 16 be in contact with the ground surface 68, as shown in FIG. 3.

When at the normal operating, or first, position, it is important that a significant portion of the weight of the hood member 16 be transferred to the frame 12 through the hood support assembly 18, thereby reducing wear and drag on the bottom surfaces 64 of the hood member. More specifically, in the present invention, the weight of the hood member 16 is transferred through the adjustable links 34,36 to the second ends 32,32' of the arm members 26,28. The support member 20, being pivotally mounted to the frame 12, is able to pivot, or rotate about its longitudinal axis. Thus, a downwardly directed force applied at the second ends 32,32' of the arm members will result in a corresponding upward movement of the contact surface portions 48,48' toward the springs 52,54. To avoid exceeding the load limit of the spring members 52,54, compression of the springs is limited by the contact of the centrally disposed pins 50,50' on the stop members 42,44 with the compression limit pins 62,62' positioned in the central openings 60,60' of the spring members.

An upwardly directed force applied at the second end of the arm members, will move the contact surface portions downwardly and away from the springs. Upwardly directed forces will be applied to the second ends of the arm members when the rotor 14 is raised a short distance above the ground and the rotor journals contact the upper closed ends of slots 70,70' in the side walls of the hood member so that, upon further elevation of the rotor, the hood member 16 will also be lifted.

Thus, in carrying out the present invention, it is important that the length of each of the adjustable links 34,36 be adjusted so that, when the hood member 16 is in substantive contact with the ground surface 68, the contact surface portion 48,48' of each stop member 42,44 will bear against a respective spring 52,54 with sufficient force to fully compress the springs. Further, it should be noted that both of the arm members 26,28 and both of the stop members 42,44 are rigidly attached to the support member 20. Thus, the support member 20 serves as a torque transfer element to distribute the forces, transmitted to the frame 12 through the hood support assembly 18, substantially equally to both sides of the support assembly. Further, the side-to-side load equalization provided by the hood support assembly 18 effectively maintains each side of the hood member 16 at substantially the same vertical position with respect to the frame 12, thus providing lateral stability to the hood member 16 during operation of the machine.

A stabilizing link 70, oriented along the longitudinal axis of the earth working machine 10, is pivotally connected at one end to the frame 12 and at the other end to the hood member 16. The stabilizing link 70 forms, in cooperation with the frame, the hood support assembly 18, the drive cases 72,72', and a portion of the hood member 16, links of a structure that maintains the bottom surfaces 64 of the hood member 16 in a parallel relationship with the ground during raising and lowering of the hood member. Furthermore, the stabilizing link 70 controllably restricts fore and aft pitching motions of the hood member.

INDUSTRIAL APPLICABILITY

The hood support assembly 18 embodying the present invention is particularly useful for transferring a substantial portion of the weight of a protective hood member 16 of an earth working machine directly to the frame of the machine during normal operations, machines of this type are conventionally used to stabilize soil, reclaim roadways, pulverize excavated material, and mix additive materials with soil or reclaimed roadway materials.

The hood support assembly 18 embodying the present invention also distributes the weight and dynamic forces associated with the hood member 16 substantially equally between each of the spaced ends of the support assembly. Furthermore, during cutting operations, the support assembly 18 maintains the hood member 16 in a parallel position with respect to the frame 12, thereby preventing contact between the hood member and the ground engaging tools mounted on the rotor 14.

Other aspects, objects and advantages of this invention can be obtained from a study of the drawing, the disclosure, and the appended claims.

I claim:

1. A hood support assembly (18) for an earth working machine (10) having a frame (12), a horizontally disposed rotor (14) having ground engaging tools mounted thereon, and a hood member (16) defining an open bottom mixing chamber about said rotor (14), said hood support assembly (18) comprising:

a support member (20) having first and second end portions (22,24) and being pivotally connected to said frame (12) at each of said end portions (22,24);

first and second arm members (26,28) each having first and second end portions (30,30',32,32'), the first end portion (30,30') of each arm member (26,28) being attached to a respective end portion (22,24) of the support member (20);

first and second adjustable link members (34,36) each having first and second end portions (38,38',40,40'), the first end portion (38,38') of each adjustable link member (34,36) being pivotally connected to the second end portion (32,32') of a respective one of said arm members (26,28) and the second end portion (40,40') of each adjustable link member (34,36) being pivotally connected to said hood member (16);

first and second stop members (42,44) each having an end portion (46,46') and a contact surface portion (48,48') spaced from said end portion (46,46'), said end portion (46,46') of each stop member (42,44) being attached to a respective end portion (22,24) of the support member (20); and, first and second springs (52,54) each having first and second end portions (56,56',58,58'), the first end portion (56,56') of each spring (52,54) being attached to said frame (12) and the second end portion (58,58') of each spring (52,54) being abuttable with a respective contact surface portion (48,48').

2. A hood support assembly (18), as set forth in claim 1, wherein said hood member (16) has a bottom surface (64) and is vertically movable between a first position at which said bottom surface (64) is in contact with a ground surface (68) supporting said earth working machine (10) and a second position at which said bottom surface (64) is spaced from said ground surface (68), and the second end portion (58,58') of each spring (52,54) forcedly abuts said respective contact surface portion (48,48') when the hood member (16) is at said first position and is spaced from the respective contact surface portion (48,48') when said hood member (16) is at said second position.

3. A hood support assembly (18), as set forth in claim 1, wherein said springs (52,54) are spherical elastomeric springs (52,54).

* * * * *